US006393875B1

(12) United States Patent
Garel et al.

(10) Patent No.: US 6,393,875 B1
(45) Date of Patent: May 28, 2002

(54) PROJECTION LOCK RECEIVER AND METHOD FOR USING A PROJECTION LOCK

(75) Inventors: Michael R. Garel; Christopher M. Jaggers, both of Austin, TX (US)

(73) Assignee: Dell Products, L.P., Round Rock, TX (US)

( * ) Notice: Subject to any disclaimer, the term of this patent is extended or adjusted under 35 U.S.C. 154(b) by 0 days.

(21) Appl. No.: 09/518,291

(22) Filed: Mar. 3, 2000

(51) Int. Cl.[7] ..... E05B 73/00
(52) U.S. Cl. ..... 70/18; 70/14; 70/53; 70/57.1
(58) Field of Search ..... 70/14, 18, 20, 70/41, 53, 58, 49, 57.1, 258

(56) References Cited

U.S. PATENT DOCUMENTS 3,667,259 A 6/1972 Reque et al.
4,085,599 A 4/1978 Fischer et al.
5,117,661 A 6/1992 Carl et al.
5,381,685 A 1/1995 Carl et al.
5,673,574 A 10/1997 Bertram
5,791,171 A 8/1998 Kelley
5,995,366 A 11/1999 Howell et al.
6,006,557 A 12/1999 Carl et al.
6,055,832 A * 5/2000 Wyers ..... 70/34

* cited by examiner

*Primary Examiner*—Gertrude Arthur
(74) *Attorney, Agent, or Firm*—Russell D. Culbertson; Shaffer & Culbertson LLP

(57) ABSTRACT

A portable projection lock receiver (10) includes a shackle portion (12) adapted to fit through an opening (38) on the device to be secured. The shackle portion (12) of the projection lock receiver (10) has an open section (18) and a first opening (30) formed at one end. A closure member (14) associated with the shackle includes a second opening (28) which may be aligned with the first opening (30). In this aligned position, the closure member (14) closes the shackle open section (18) and the two aligned openings (28, 30) together form a projection lock receptacle. This projection lock receptacle is conformed to receive and retain a suitably sized projection portion of a projection lock.

20 Claims, 2 Drawing Sheets

PROJECTION LOCK RECEIVER AND METHOD FOR USING A PROJECTION LOCK

TECHNICAL FIELD OF THE INVENTION

This invention relates to locking systems of particular use in locking portable computers and similar devices. More specifically, the invention relates to a portable Kensington style or projection lock receiver for adapting a projection lock to secure a device such as a computer system which is not specifically designed for use with a projection lock.

BACKGROUND OF THE INVENTION

Portable computer systems have become very popular to both business travelers and users who simply prefer the flexibility provided by portable systems. Aside from the portable computer systems themselves, many types of accessories have been developed to increase the functionality and utility of portable computer systems. For example, many modular devices such as modular CD drives have been developed specifically for use with portable computer systems. These modular devices simply plug in to modular receptacles built in the portable computer and may be readily removed and switched out for other devices. Also, docking stations have been developed for receiving a portable computer so that the portable computer may be used conveniently at a fixed location. These docking station/portable computer combinations provide many of the benefits of standard computer systems while allowing the portable computer to be removed for use out of the office.

Although such portable systems present many advantages, the portability and modular nature of these systems does raise security issues. In particular, portable computers and the modular components used in portable and other computer systems have been easy targets for thieves. To address security issues, many locking arrangements have been developed for securing a computer system and its various components in place. Computer system and accessory manufacturers arc also incorporating security features into their products and providing attachments and structures intended to accommodate a variety of locks. Docking stations have been developed with comprehensive locking arrangements which can be actuated to lock in place both the portable computer received in the station and other modular components. Once actuated, the locking arrangement can be fixed in place using a padlock or other type of lock. This allows a single lock to effectively secure an entire modular system.

A popular lock for use in securing electronic devices, commonly referred to as a Kensington lock, has been developed by Kensington Microware, Ltd. of San Mateo, Calif. Various embodiments of a Kensington lock are disclosed in U.S. Pat. No. 5,381,685, and this patent is incorporated herein by reference. A Kensington lock includes a locking projection which cooperates with a special receptacle feature on the device to be secured. The locking projection is mounted on a base which itself may be connected to a cable or chain which may be secured at its opposite end. The receptacle feature on the device to be secured comprises a rectangular slot having preselected dimensions. The Kensington lock is used by first positioning the locking projection in the receptacle and then turning an end portion of the locking projection using a key for the lock. The turned end portion now misaligns with the slot and prevents the projection from being removed from the slot until turned back to the aligned position using the key for the lock. Many portable computer users prefer Kensington locks for their compact nature, portability, and ease of use.

Other lock manufacturers provide locking devices utilizing one or more projections which may be inserted into a properly sized slot or other opening and then misaligned to prevent the projection, and thus the lock, from being removed. A lock which uses one or more projections to cooperate with a specially sized opening will be referred to in this disclosure as a "projection lock." The term "projection lock" is intended to encompass Kensington locks and similar locking devices. The opening with which a projection lock is intended to cooperate will be referred to in this disclosure as a "projection lock receptacle."

Portable computer and docking station manufacturers commonly provide structures or attachments on their products which accommodate different types of locks so as to give the customer a choice of security solutions. For example, a portable computer may include both a projection lock receptacle and an opening for receiving a padlock. A problem arising in some instances, however, is that the projection lock receptacle location may be so close to a system component that the installed projection lock blocks access to the component. As a result, the user is forced to remove the projection lock in order to gain full access to the blocked component. In order to avoid having to continually lock and unlock the system to gain the desired access, the user may abandon their projection lock and use an alternative device, such as a padlock to lock the computer system.

Another problem arises when a computer system does not include the special receptacle required by a projection lock. In this case, the only alternative is to use a padlock rather than a projection lock.

Whether the projection lock is abandoned because the projection lock receptacle is inconveniently located or because the receptacle is not available at all, the user is forced to abandon what may be their preferred security device. This is particularly unsatisfactory in corporations that have standardized on a particular projection lock.

SUMMARY OF THE INVENTION

It is an object of the invention to provide a projection lock receiver that allows a projection lock to be used to secure a device even when the device includes no projection lock receptacle. Another object of the invention is to provide a method for adapting a device to receive a projection lock.

A portable projection lock receiver according to the invention includes a shackle portion adapted to fit through an opening on the device to be secured. The shackle portion of the projection lock receiver has an open section and a first opening formed at one end. A closure member associated with the shackle includes a second opening which may be aligned with the first opening. In this aligned position, the closure member closes the shackle open section and the two aligned openings together form a projection lock receptacle. This projection lock receptacle is conformed to receive and retain a suitably sized projection associated with a projection lock. In a preferred embodiment of the invention, the shackle includes a U-shaped member and the closure member is pivotally connected at the end of the U-shaped member opposite to the end having the first opening. The second opening on the closure member is located at the end of the member opposite to the end connected to the shackle so that the closure member may be pivoted to align the second opening with the first opening or slot formed on the shackle.

The projection lock receiver according to the invention is used by first hooking the shackle through an opening such as a padlock receiving opening on a computer system to be secured. The closure member is then moved to align the closure member opening or slot with the shackle slot to form a projection lock receptacle. A properly sized projection portion of a projection lock may then be inserted into the receptacle formed by the aligned slots and then the end portion of the projection lock turned to lock the shackle and closure member together with the closure member covering or otherwise blocking the open section of the shackle. In this position, the shackle portion of the projection lock receiver according to the invention functions similarly to the shackle of a padlock to secure the device through the padlock receiving opening. However, the shackle portion of the projection lock receiver is locked in place with the projection lock.

The projection lock receiver according to the invention allows a projection lock to be conveniently used to secure a device even if the device includes no built-in projection lock receptacle, or if the projection lock receptacle on the device is inconveniently located. A company may thus standardize on the projection lock solution without having to worry about incompatibility between projection locks and devices to be secured. Furthermore, the receiving arrangement according to the invention is portable from one security application to the next.

These and other objects, advantages, and features of the invention will be apparent from the following description of the preferred embodiments, considered along with the accompanying drawings.

DESCRIPTION OF THE PREFERRED EMBODIMENTS

Figure 1:
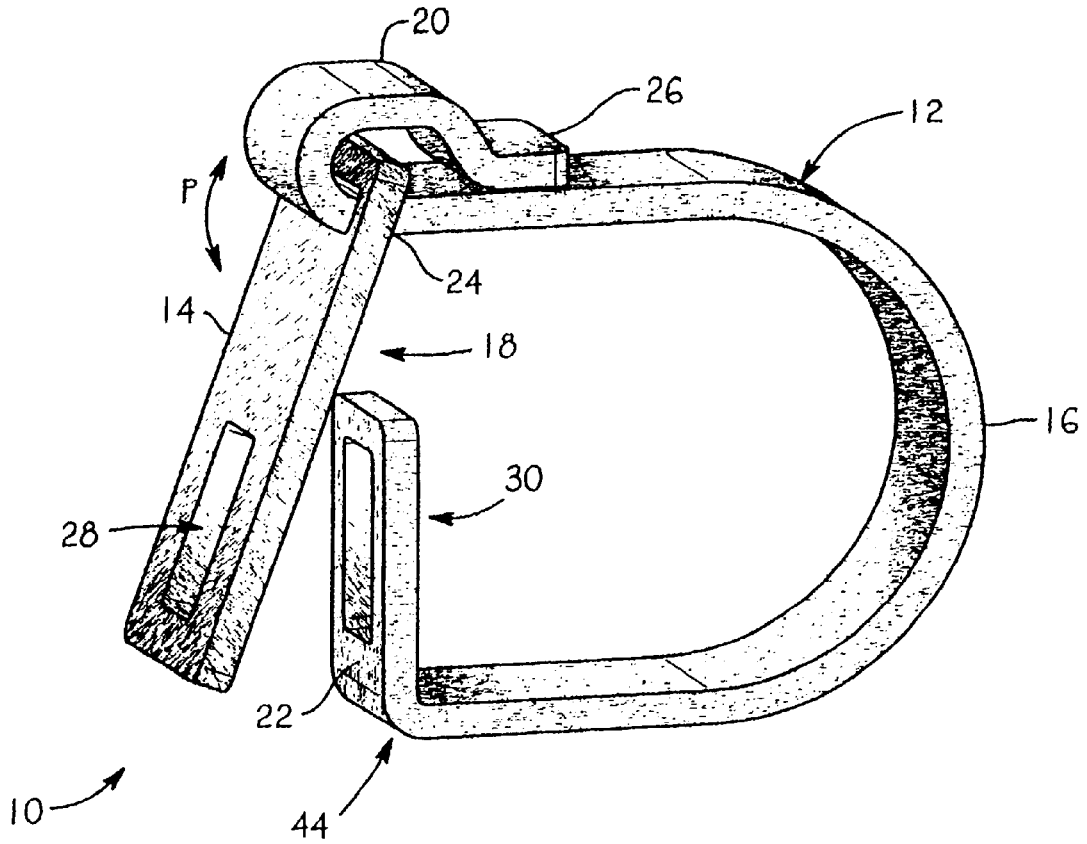
FIG. 1 is an isometric view of a projection lock receiver embodying the principles of the invention.

A preferred embodiment of the present invention is illustrated by way of example in FIGS. 1 through 4. With specific reference to FIG. 1, portable projection lock receiver 10 includes a shackle portion 12 and a closure member 14. Shackle portion 12 includes loop shaped, curved closed end 16 and open section 18. Open section 18 lies adjacent to, and is formed by, a connection end 20 and a mating surface 22. In the preferred embodiment, mating surface 22 is formed by creating a 90 degree angle at the end of shackle 12 opposite to connection end 20. Closure member 14 preferably includes connection opening 24 at one end secured at connection end 20 of shackle 12. In the illustrated preferred form of the invention, connection end 20 forms a loop which receives closure member 14 in a pivot connection which allows the closure member to pivot as indicated by arrow P in FIG. 1. Closure member 14 also includes opening 28 in the form and dimension of a projection lock receptacle. Mating surface 22 of shackle 12 includes a corresponding opening 30 that is adapted to align with opening 28. When closure member 14 is placed over mating surface 22, thereby closing open section 18 of shackle 12, opening 28 and opening 30 together form an opening that functions as a projection lock receptacle.

Figure 2:
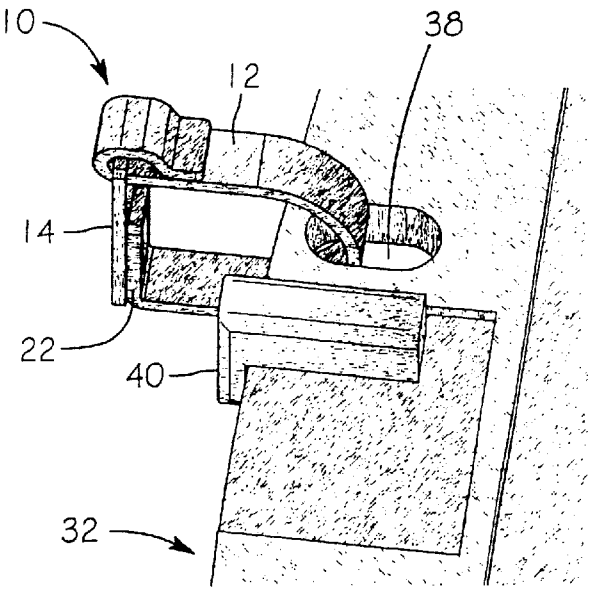
FIG. 2 is an isometric view the projection lock receiver shown in FIG. 1, attached to a computer system through a padlock receiving opening in the system.

Referring now to FIG. 2, a docking station 32 portion of a modular computer system is adapted to receive a portable computer (not shown) as is known in the art. Docking station 32 includes a locking mechanism actuated by lever 40. When lever 40 is moved to the locked position shown in the figure, portions of the locking mechanism align to form a locking structure or padlock opening 38.

Figure 3:
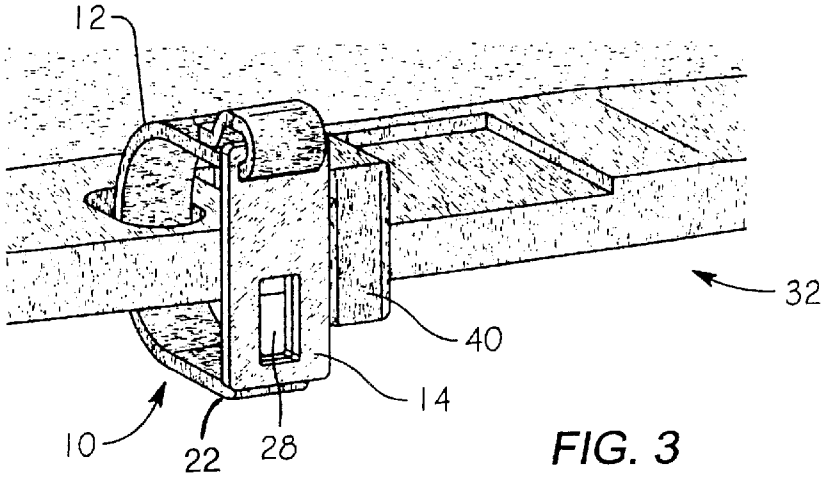
FIG. 3 is an isometric view similar to FIG. 2, but from a different perspective.

Referring particularly to FIGS. 2 and 3, portable projection lock receiver 10 is utilized by passing one end of shackle 12 through padlock opening 38. Once in that position, closure member 14 is aligned with mating surface 22 with openings 28 and 30 aligned so as to form the required projection lock receptacle.

Figure 4:
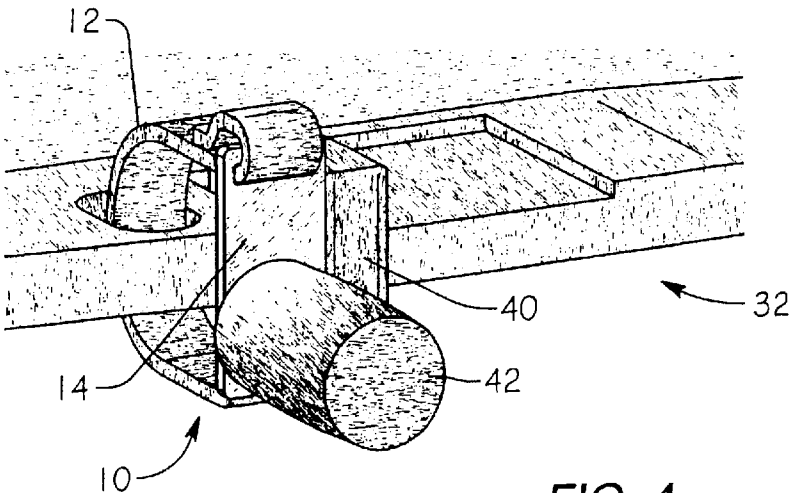
FIG. 4 is an isometric view similar to FIG. 3, but showing a projection lock attached to the projection lock receiver of the present invention.

Referring to FIG. 4, projection lock 42 is connected to portable projection lock receiver 10 by inserting the projection portion of the lock (not shown) into the projection lock receptacle formed by the combination of opening 28 and opening 30 as previously described. As is known in the art, once the end portion of the projection lock projection is misaligned in the projection lock receptacle, the projection lock 42 is secured in place. It will be appreciated that the end portion of the projection is turned using a key inserted into a key opening (not shown) commonly located on the end of projection lock 42.

Portable projection lock receiver 10 can be made of any materials having sufficient strength and resistance to breakage. Hardened steel and similar materials are ideal for use in the receiver according to the invention.

Portable projection lock receiver 10 can take any form suitable for the purpose desired by the user. That is to say, the shapes of shackle 12 and closure member 14 are not critical except that the elements must be able to form a substantial enclosure or ring having a projection lock receptacle by the combination of openings 28 and 30. In this regard, the locking receptacle formed by openings 28 and 30 may be modified to mirror any receptacle suitable for cooperation with a projection lock. Alternative shackle and closure member arrangements may comprise two members of similar length, pivotally connected together at one end with the other ends having openings corresponding to openings 28 and 30 described above with reference to the illustrated embodiment.

While the portable projection lock receiver 10 of the present invention has been disclosed primarily for use in connection with computer systems, it will be appreciated that portable projection lock receiver 10 can be used in securing systems other than computers or electronic devices. The present invention provides an improved portable lock receiver that can be utilized with any projection type lock 42 to secure any equipment or materials a user desires.

The above described preferred embodiments are intended to illustrate the principles of the invention, but not to limit the scope of the invention. Various other embodiments and modifications to these preferred embodiments may be made by those skilled in the art without departing from the scope of the following claims.

What is claimed is:

1. A projection lock receiver comprising:

(a) a shackle member having an open section and having a first opening adjacent to the open section;

(b) a closure member having a second opening adapted to align with the first opening with the closure member covering the open section of the shackle; and (c) the aligned first opening and second opening adapted to operatively receive a projection portion of a projection lock.

2. The apparatus of claim 1 wherein the aligned first opening and the second opening form a projection lock receptacle that is approximately rectangular with preselected dimensions.

3. The apparatus of claim 1 wherein the first opening adjacent the shackle open section is formed in a member extending at a right angle bend at an end of the shackle.

4. The apparatus of claim 3 wherein the first opening is identical in size and shape to the second opening.

5. The apparatus of claim 1 wherein the shackle member includes an elongated portion that is curved to from a closed end.

6. The apparatus of claim 1 wherein the shackle member includes a loop at the end opposite to the end having the first opening, and wherein the closure member connects to the shackle through the loop.

7. The apparatus of claim 1 wherein the closure member is pivotally connected to the shackle member.

8. A method for using a projection lock to secure a device without using a projection lock receptacle formed on the device, the method comprising the steps of:

(a) extending a shackle member through an opening through the device;

(b) closing an open section of the shackle with a closure member;

(c) aligning a first opening at a first end of the shackle member with a second opening on the closure member; and (d) inserting a projection portion of a projection lock into the receptacle formed by the aligned first opening and second opening and locking the projection lock in the receptacle.

9. The method of claim 8 wherein the first and second openings are each approximately rectangular in shape with preselected dimensions.

10. The method of claim 8 wherein the first opening is formed in a member extending at a right angle to adjacent portions of the shackle.

11. The method of claim 10 wherein the first opening is identical to the second opening.

12. The method of claim 8 wherein the step of closing the open section of the shackle comprises pivoting the closure member about a pivot axis to position the closure member over the open section.

13. The method of claim 8 wherein the shackle member comprises a U-shaped member.

14. The method of claim 8 wherein the opening through the device comprises an opening adapted to receive a padlock shackle.

15. The method of claim 8 wherein the shackle includes an elongated portion that is curved to form a closed end of the shackle.

16. A computer system including:

(a) a locking structure on the computer system;

(b) a shackle member having an open section and having a first opening adjacent to the open section, the shackle member hooked through the locking structure;

(c) a closure member having a second opening adapted to align with the first opening with the closure member covering the open section of the shackle; and (d) the aligned first opening and second opening adapted to operatively receive a projection portion of a projection lock.

17. The system of claim 16 wherein the first opening and the second opening form a projection lock receptacle that is approximately rectangular with preselected dimensions.

18. The system of claim 17 wherein the first opening adjacent the shackle open section is formed in a member extending at a right angle bend at an end of the shackle.

19. The system of claim 18 wherein the first opening is identical in size and shape to the second opening.

20. The system of claim 16 wherein the shackle member includes an elongated portion that is curved to form a closed end.

* * * * *